United States Patent [19]

Nelson

[11] 4,333,681

[45] Jun. 8, 1982

[54] POWER OPERATED RECLINING WHEELCHAIR

[76] Inventor: M. Eugene Nelson, 4921 Gary St., San Diego, Calif. 92115

[21] Appl. No.: 94,729

[22] Filed: Nov. 16, 1979

[51] Int. Cl.[3] ..... A47C 1/034

[52] U.S. Cl. ..... 297/83; 297/DIG. 4; 297/330

[58] Field of Search ..... 297/83, 84, 86, 319, 297/330, DIG. 4, 320, 321; 180/6.5; 5/37 R

[56] References Cited

U.S. PATENT DOCUMENTS

| | | | |
|---|---|---|---|
| 2,660,225 | 11/1953 | Luckhardt | 297/86 |
| 2,976,868 | 3/1961 | Weissenberg | 297/90 |
| 3,111,181 | 11/1963 | Yatich | 297/DIG. 4 |
| 3,191,990 | 6/1965 | Rugg et al. | 297/83 |
| 3,657,747 | 4/1972 | Rogers, Jr. et al. | 5/37 R |
| 3,934,929 | 1/1976 | Rabinowitz | 297/319 |
| 3,936,893 | 2/1976 | Anderson | 297/90 X |
| 4,000,529 | 1/1977 | De Maria | 5/37 R |
| 4,183,578 | 1/1980 | Naganawa | 297/DIG. 4 |
| 4,285,541 | 8/1981 | Ohishi | 297/DIG. 4 |

*Primary Examiner*—James T. McCall
*Attorney, Agent, or Firm*—Charles C. Logan, II

[57] ABSTRACT

A power operated reclining wheelchair having a frame assembly with a base frame and a pair of laterally spaced sidewall frames extending upwardly from the opposite lateral sides of the base frame. Each of the sidewall frames have a fixed major pivot point located adjacent its rear end at a location approximating that of the hip joint of the occupant of the wheelchair. The wheelchair also has a back rest assembly and a seat assembly and mechanical and electrical structure for pivotally reclining the back rest assembly about the major pivot points in coordinated movement with the seat assembly during which the front end of the seat assembly is tilted upwardly and forwardly advanced from its initial position while its rear end is slightly lowered and forwardly advanced from its initial position. Continued movement of the seat assembly brings it to a final position where the front end and the rear end of the seat assembly are substantially horizontal and at substantially the same vertical height that they were at the initial position, but with the seat assembly positioned forwardly of its initial starting position. A footrest assembly is also pivotally connected to the front of the seat assembly and mechanical structure coordinates its movement with that of the back rest assembly and the seat assembly.

12 Claims, 6 Drawing Figures

POWER OPERATED RECLINING WHEELCHAIR

BACKGROUND OF THE INVENTION

The invention relates to a wheelchair and more particularly to a novel power operated reclining wheelchair.

In the past, power operated reclining wheelchairs have been designed for use by quadraplegics and other persons having different degrees of paralysis. One such wheelchair is that illustrated in U.S. Pat. No. 3,111,181. This wheelchair has power means for adjusting the occupant supporting portion into a variety of positions under the control of the operator. It has been designed to function in such a manner that the center of mass of the occupants body remains centered over the wheel of the vehicle independently of a particular position of the seat and back members.

Another prior art wheelchair is illustrated in U.S. Pat. No. 3,191,990. The wheelchair in this patent has been designed to allow the occupants to position themself at any desired position between a substantially upright and a fully reclined position.

The major draw back to present day reclining wheelchairs is that they do not prevent shearing action on the skin of the occupant as the back portion and the seat portion move during the reclining operation of the wheelchair. This shearing occurs as the occupant tends to slide out of the wheelchair both during the time when the seat back is being lowered and that period of time when the seat back is being brought back into a sitting position.

Additionally, present day wheelchairs have not been designed to alleviate conditions which produce pressure sores on the buttock area of the occupant. These pressure sores develop from a person sitting too long in one position especially, paralyzed people when using wheelchairs. These persons are unable to sense the pressure effect because of lack of feeling in the area affected. They are basically sitting on a bony area, the ischial bones in the buttocks area for too long a period of time during which the pressure of the bone against the flesh tissue below it cuts off the blood supply to certain areas and allows the flesh to rot or deteriorate to the point of causing open sores. These sores are extremely costly to repair through surgery, that requires hospitalization for up to three or four months.

It is an object of the invention to provide a novel power operated reclining wheelchair that can be used by its occupant to prevent pressure sores on the buttocks area. It is also an object of the invention to provide a novel power operated reclining wheelchair whose coordinated movement will prevent shearing of the skin as well as preventing sliding out of the wheelchair during the portion of the time that the back is brought up into a sitting position from a reclined position.

It is also an object of the invention to provide a novel power operated reclining wheelchair capable of being reclined in a multiplicity of angles to achieve slight variations and changes in reducing muscular fatigue and pressure on the occupant's chair contact surfaces.

It is also an object of the invention to provide a novel power operated reclining wheelchair rugged enough for indoor and outdoor use.

It is also an object of the invention to provide a novel power operated reclining operated wheelchair having a novel front wheel suspension.

It is a further object of the invention to provide a novel power operated reclining wheelchair whose foot rest assembly's operation is designed to prevent spasticity of the leg of the occupant when the leg is straightened out too much.

It is an additional object of the invention to provide a novel power operated reclining wheelchair having an exterior body which gives it a non-clinical appearance.

SUMMARY OF THE INVENTION

Applicant's novel power operated reclining wheelchair has a frame assembly having a base frame and a pair of laterally spaced sidewall frames extending upwardly from the opposite lateral sides of the base frame. Each of the sidewall frames has a fixed major pivot point located adjacent its rear end at a position approximating the hip joint of the occupant of the wheelchair. The wheelchair also has a back rest assembly and a seat assembly along with electrical and mechanical structure for pivotally reclining the back rest assembly about the major pivot points in coordinated movement with the seat assembly during which the seat assembly travels through its cycle from its initial position to an intermediate travel position and then on to its final position. At the initial position, the front end and the rear end of the seat assembly are substantially horizontal. At the intermediate travel position the front end of the seat assembly is tilted upwardly and forwardly advanced from its initial position while its rear end is positioned lower than and forwardly advanced of its initial position. At its final position the front end and the rear end of the seat assembly are substantially horizontal and at substantially the same vertical height that they were in the initial position and the front end and rear end are advanced forwardly from their intermediate travel position.

The structure for pivotally reclining the back rest assembly about the fixed major pivot points is a U-shaped frame member that is attached to the back rest assembly adjacent its bottom. This U-shaped frame member also has a minor pivot point located rearwardly and below each of the major pivot points when the back rest is in its upright position. The seat assembly has a pair of laterally spaced seat frame brackets extending upwardly from a position adjacent the rear end of the seat assembly and each of the frame brackets have an aperture formed adjacent its top end for receiving a pin that extends axially along the minor pivot points. The U-shaped frame member has a set of apertures adjacent each of its opposite ends that align respectively with the major pivot points and the minor pivot points.

A bellcrank pivot point is located in each of the sidewall frames adjacent its front end. A bellcrank is pivotally mounted to each of these sidewall frames about the bellcrank pivot pins and a pair of laterally spaced seat frame brackets are attached to the seat assembly adjacent its forward end and pushrod members have their opposite ends pivotally secured respectively to the seat frame brackets and the bellcrank. A pair of laterally spaced brackets are attached to the respective arms of the U-shaped frame member and pushrod members have their opposite ends pivotally secured respectively to the brackets and the bellcranks. It can thus be easily understood that as the back rest assembly is made to recline, the minor pivot points that support the rear of the seat assembly are caused to rotate around the major fixed pivot points. Also the respective pushrod members connected between the U-shaped frame member and the bellcrank members will cause the bellcrank members to rotate which in turn causes the pushrod connected between the seat assembly brackets and the bellcranks to lift the forward portion of the seat assembly upwardly in a tilting manner.

A foot rest assembly is pivotally attached at its top end to the front end of the seat assembly. The foot rest assembly has a pair of laterally spaced brackets attached to it at a point spaced downwardly from where the foot rest assembly is pivotally attached to the front end of the seat assembly. Push rod members have their opposite ends pivotally secured respectively to these brackets and the bellcranks, accordingly, when the bellcrank members rotate about their fixed pivot points as described previously the foot rest assembly will be initially lifted upwardly a predetermined distance after which the pushrods attached to its brackets will cause the footrest assembly to be pivoted outwardly at a predetermined angle.

An electric ram having a telescoping ram member has its lower end pivotally attached to the base frame and the top end of the telescoping ram member is pivotally attached to a bracket extending downwardly from the center of the U-shaped frame member. It is the electric ram that controls the reclining of the back rest assembly while the previously described structure controls the coordinated motion between the back rest assembly, the seat assembly, and the foot rest assembly.

The fundamental concept of the structure involved in applicant's novel wheelchair is to have a coordianted movement between the seat assembly, the back rest assembly, and the foot rest assembly, to prevent shearing of the skin of the occupant during the reclining movement as well as to prevent sliding out of the wheelchair during the portion of the time that the back assembly travels between the sitting position and the reclined position.

The unique correlation of the previously enumerated major assembly's also prevents pressure sores on the critical Coccyx and Ichial areas of the occupant. The reclining fixed major pivot point is located at the occupant's hip joint position to allow the occupant's body to flex normally without shearing action on his back and buttocks. Thus as the person reclines his body bends at the ball and socket joint of the hip and likewise the back assembly pivots about the same primary axis. The ichial bones which bear the primary burden of sitting are proximately 1½ to 2 inches below the hip joint. Therefore, during the reclining operation of the body, these ichial bones rotate in an arc under the hip joint in a radius of 1½ inches to 2 inches.

The footrest assembly during the first half of its cycle, rises up vertically two to three inches which benefits clearance problems when coming down an inclined ramp or driveway of situation where foot pedal assembly would gouge into the street or floor. Thus, by slightly reclining the back assembly, the needed additional clearance may be obtained during critical times. During the last half of the cycle of the foot rest assembly, it is extended at approximately a 45 degree angle because full extension to horizontal position causes most quadraplegics or people with spinal cord injuries to have a tendency to spasticity if the leg is straightened out too much. This presents the occupant with a comfortable position for his lower limbs and prevents a tendency of the foot to jump out of the foot pedal assembly due to spasticity.

With applicant's novel wheelchair, the occupant can vary his position in a number of angles to achieve a slight variation and change in the muscular fatigue and pressure resulting to his body. Applicant's wheelchair has proven the effect of a reduction of pressure by actual pressure sensing tests run in which sensing pads were put under the buttocks area and the chair was put through its recline cycle. It has been found that by thus reducing the pressure in the buttocks area recirculation of the blood is allowed to occur and restore the normal healthy flow of circulation to the tissues involved. A reclining cycling period every hour of five to ten minutes would appear to eliminate the problem of direct pressure involvement that produces pressure sores.

The wheelchair has a unique front suspension for traveling over rough terrain that allows the wheels to be equalized so that all four wheels are on the ground in a contact position.

A plastic or fiberglass outer body gives the chair a nonclinical appearance and also protects the internal mechanisms from weather, dust and dirt contamination.

DESCRIPTION OF THE PREFERRED EMBODIMENT

Figure 1:
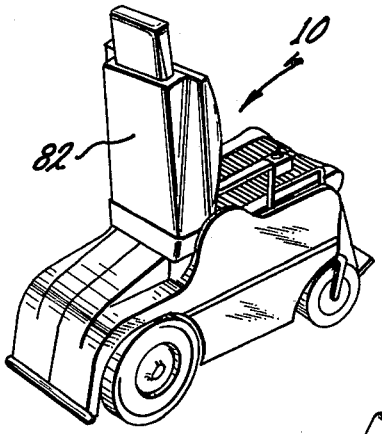
FIG. 1 is a perspective view of the novel power operated reclining wheelchair in its upright position.
Figure 2:
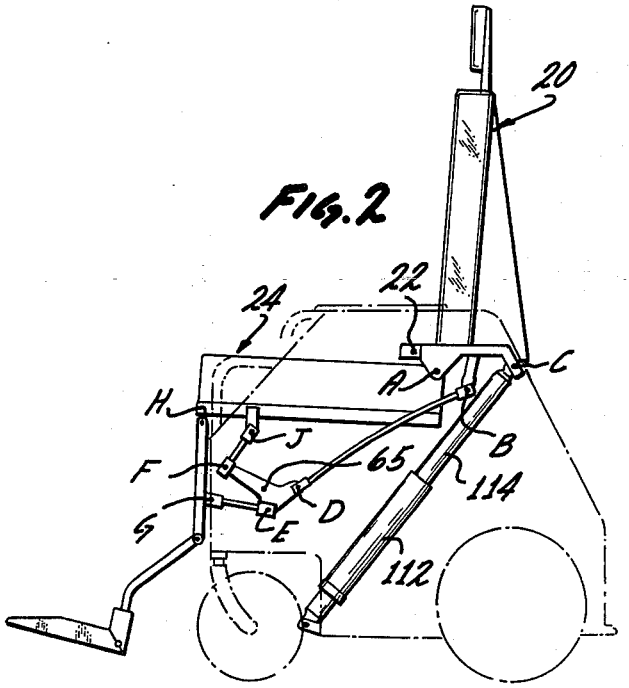
FIG. 2 is a schematic view of the novel power operated reclining wheelchair.
Figure 3:
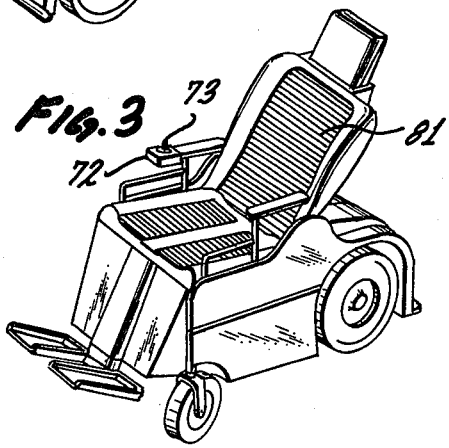
FIG. 3 is a perspective view of the novel power operated reclining wheelchair in its partially reclined position.
Figure 4:
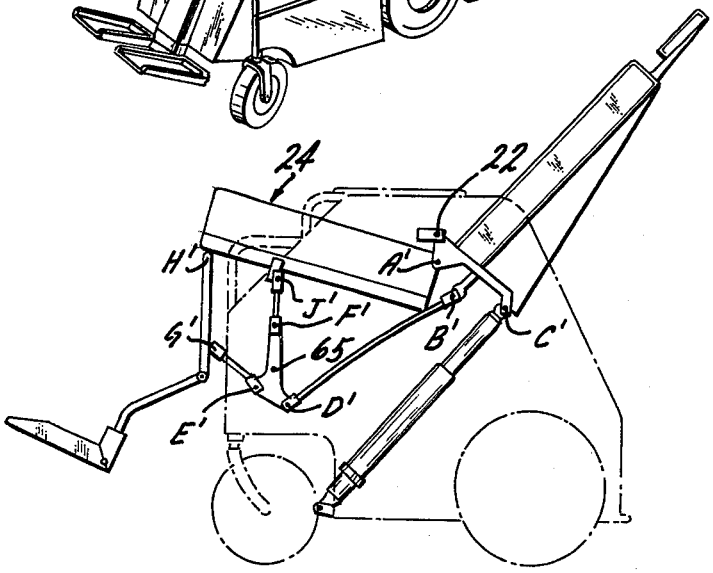
FIG. 4 is a schematic view of the novel power operated reclining wheelchair in its semi-reclined position.
Figure 5:
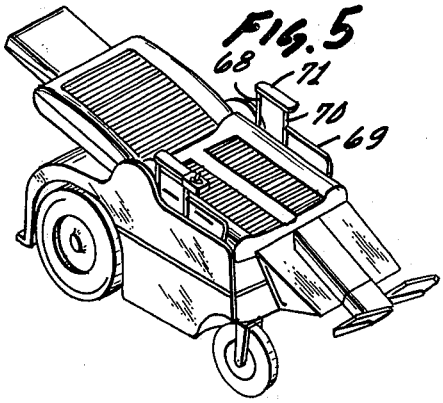
FIG. 5 is a perspective view of the novel power operated reclining wheelchair in its fully reclined position.
Figure 6:
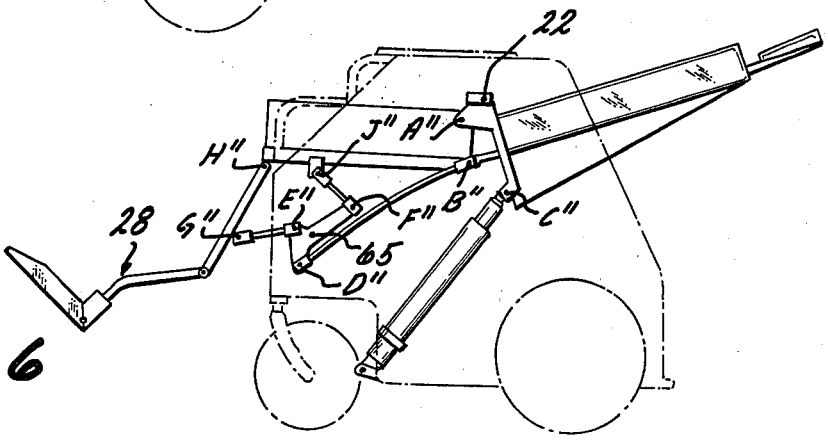
FIG. 6 is a schematic view of the novel power operated reclining wheelchair in its fully reclined position.
Figure 7:
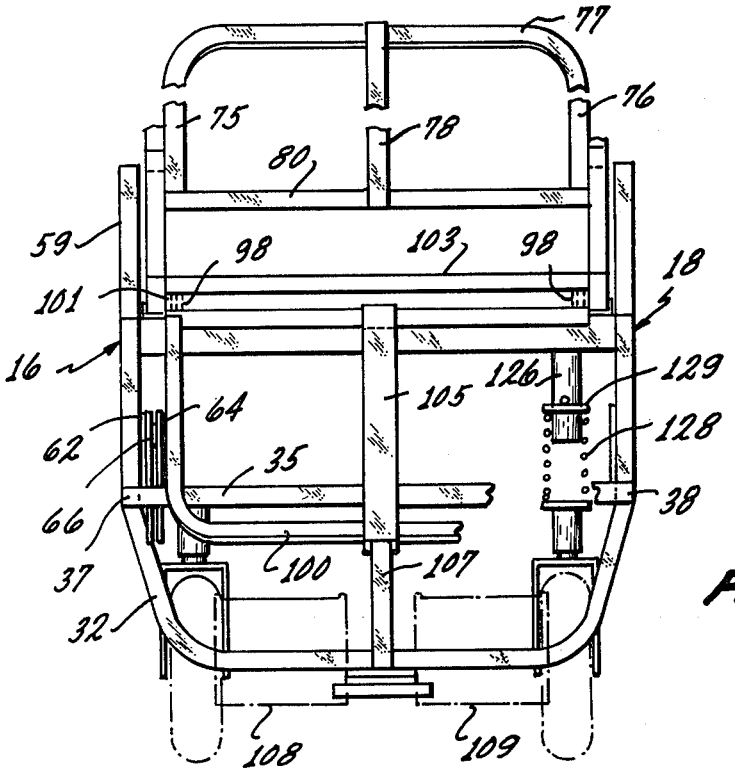
FIG. 7 is a partial front elevation view of the novel power operated reclining wheelchair having portions broken away for clarity.
Figure 8:
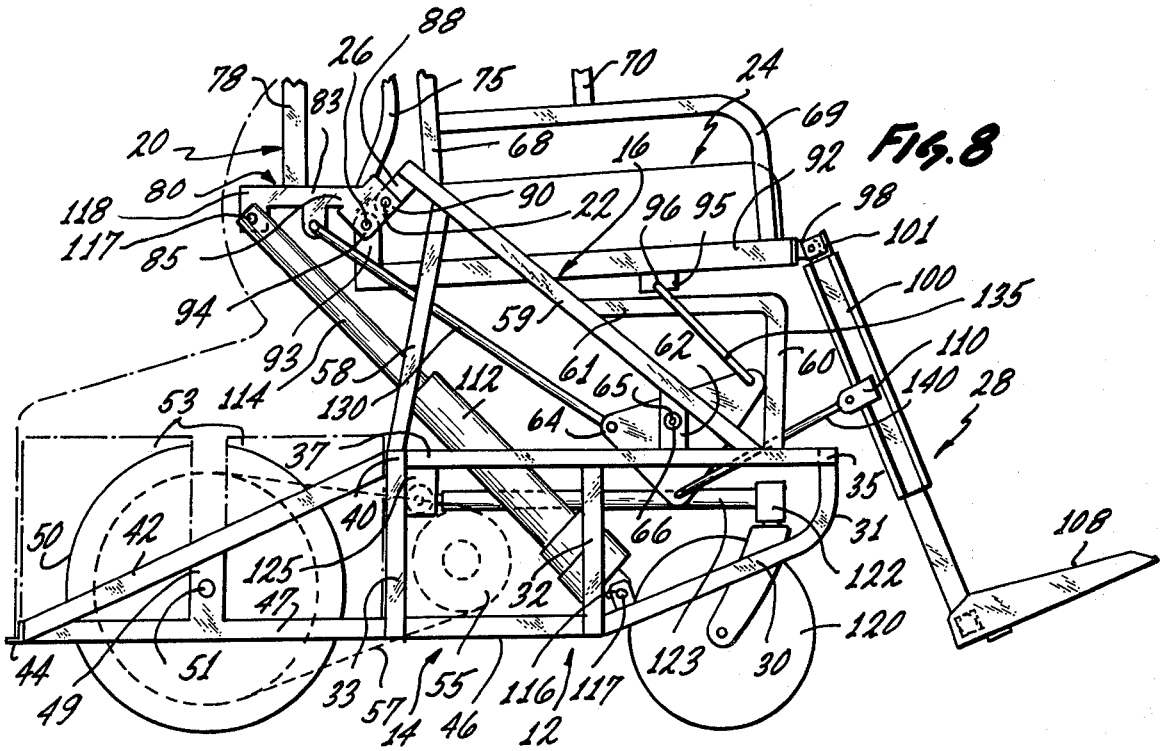
FIG. 8 is a partial side elevation of the novel power operated reclining wheelchair having portions broken away for clarity.

The novel power operated reclining wheelchair will now be described by referring to FIGS. 1–8. The wheelchair is generally designated numeral 10. It has a frame assembly 12 having a base frame 14 and a pair of laterally spaced sidewall frames 16 and 18. The back rest assembly 20 is pivotally connected to the sidewall frame members about fixed major pivot points 22. The seat assembly 24 is pivotally attached to the back rest assembly about minor pivot points 26. Foot rest assembly 28 is pivotally secured to the front of seat assembly 24.

The base frame 14 has a central longitudinal member 30 that slopes upwardly and has a vertically extending tip 31. A forward transverse U-shaped member 32 has its middle portion secured to the central longitudinal member 30. A front frame transverse member 35 has its mid-portion secured to the top of vertically extending tip 31. The opposite ends of front frame transverse 35 are secured to the respective laterally spaced side longitudinal members 37 and 38. Attached across the rear of these side longitudinal members is a mid-frame transverse member 40. The opposite ends of U-shaped members 32 and 33 are also secured to the side longitudinal members 37 and 38. A pair of diagonal brace members 42 have their forward ends secured to the mid-frame transverse member 40 at positions spaced inwardly from its ends. The rear ends of the diagonal brace members 42 are attached to a transverse member 44 of floor panel tray 46 that in turn has its forward end secured to forward transverse U-shaped member 32. Floor panel tray 46 has upwardly standing sidewalls 47 along its lateral sides. Upright axial support members 49 extend upwardly from floor panel tray 46 and have their top ends secured to diagonal brace members 42. The rear pneumatic tires 50 of the wheelchair are rotatably mounted on the opposite ends of rear axial 51. Floor panel tray 46 provides a support for the batteries 53.

The drive mechanism for the wheelchair are two DC electric motors 55 mounted on floor panel tray 46. These electric motors have a direct drive transmission through their sprocket 56 and chain 57 to sprockets on the wheels (not shown) mounted on the rear axle 51.

The sidewall frames 16 each have a rear upright member 58, a diagonal brace member 59, a forward upright member 60 and a longitudinal member 61. Bellcrank mounting bracket 62 is connected between side longitudinal member 37 and diagonal brace member 59. The bellcrank 64 are pivotally mounted about pivot point 65 on a pin or shaft 66. Also, attached to the sidewall frames are vertical members 68 and side rails 69. A vertical member 70 extends upwardly from side rail 69 and it and vertical member 68 support the arm rest 71. Supported on the forward end of arm rest 71 is control box 72 having the joy stick steering mechanism 73 extending upwardly therefrom.

The back rest assembly has laterally spaced side frame members 75 and 76 that are attached at their top end to transverse top frame member 77. A central back rest frame member 78 extends downwardly from frame member 77 and it has its lower end secured to bottom frame member 80. The back rest cushion unit 81 is secured to the back rest frame in a conventional manner. A cover 82 would hide the rear of the back rest frame. The back rest bottom frame 80 is U-shaped and it has a pair of laterally extending arms 83. These arms 83 have a bracket structure 85 secured to their forward end having a pair of apertures 86 and 87. Aperture 87 is aligned with the major fixed pivot point 22 found on bracket 88 of the sidewall frame. A pin or shaft 90 extending laterally from bracket 80 passes through aperture 87 for pivotally mounting the back rest assembly 20 about fixed major pivot point 22.

The seat assembly 24 has a seat support frame 92 having laterally spaced seat frame bracket 93 extending upwardly from its rear end. These brackets have apertures that align with apertures 86 of the back rest assembly and a pin 94 provides structure for pivotally supporting the seat assembly. Seat frame brackets 95 are secured to the bottom of seat support frame 92 and have apertures 96 adjacent their lower ends. The forward end of seat support frame 92 has a pair of laterally spaced foot pedal assembly mounting brackets 98 attached thereto.

The foot rest assembly 28 has a U-shaped frame member 100 with the respective laterally spaced brackets 101 secured to their top ends. A transverse member 103 has its opposite ends secured to the top of the U-shaped frame member 100. A tubular housing 105 has its top end secured to transverse member 103 and its bottom end secured to the middle portion of U-shaped frame member 100. The telescoping support member 107 is in turn attached to structure at its bottom that supports the individual foot pedals 108 and 109. Along the lateral sides of the U-shaped frame member 100 are attached brackets 110.

An electric ram 112 having a telescoping ram member 114 as its bottom end pivotally secured to bracket 116 by a pin 117. The top of telescoping ram member 114 has a pin 117 pivotally securing it to bracket 118 extending downwardly from the rear of U-shaped frame member 80.

The front pneumatic wheels 120 are independently sprung by a unique front suspension system. The front wheels have casters whose upper ends are telescopically received within front wheel caster mounts 122. These caster mounts are secured on the forward ends of pivot arms 123 that have their rear ends fixedly secured to a torsion bar that extends transversely between the two pivot arms 123 and which has its opposite ends pivotally mounted in brackets 125 attached to the sides of the base frame. Each wheel would have a spring support member 126 extending downwardly from the frame assembly and a spring 128 would have its top end captured by a washer 29 and its lower end captured by the top of the front wheel caster mount 122.

The manner in which the back rest assembly 20 the seat assembly 24, and the foot rest assembly 28 interact and have a coordinated movement will now be described. With the back rest assembly 20 in its upright position, the electric ram would be operated causing the back rest assembly 20 to pivot rearwardly and downwardly about fixed major pivot point 22. Since the seat assembly 24 is pivotally secured to the back rest assembly 20 about minor pivot point 26 which is designated letter A, the rear of the seat assembly will be pivoted downwardly slightly while it travels forwardly. At the same time, push rod 130 having its top end pivotally mounted at point B to the back rest assembly 20 is forced downwardly and since its lower end is pivotally attached to bellcrank 64 at point D, bellcrank 64 is thus caused to rotate about its pivot point 65. As this is occuring, push rod 135 whose lower end is pivotally secured to bellcrank 64 at point F is caused to rise upwardly. Since the top of push rod 135 is pivotally attached to seat frame bracket 95 at point J the forward end of seat assembly 24 is caused to tilt upwardly and to travel forwardly initially. Push rod 140 has its lower end pivotally attached to bellcrank 64 at pivot point E and its forward end pivotally attached to footrest assembly 28 at pivot point G. Thus as the bellcrank 64 is rotated and the seat assembly 24 lifted upwardly the foot rest assembly 28 is also lifted upwardly and slightly forwardly initially. By referring to FIG. 8, the initial position of the various pivot points are designated by the respective letters from A–J. As coordinated movement between the major components develops and the back rest assembly is brought to a partially reclined position, the pivot points are designated by their same letters but with a prime notation. Further movement of the back rest assembly to the fully reclined position shows the illustrated pivot points in their respected positions and these pivot points are designated with the double prime designation.

What is claimed is:

1. A reclining chair comprising:

a frame assembly having a base frame and a pair of laterally spaced side-wall frames extending upwardly from opposite lateral sides of said base frame, each of said sidewall frames having a fixed major pivot point located adjacent its rear end, said major pivot points being substantially co-axial and being located approximately at the hip joint of the occupant of the chair;

a back rest assembly;

a seat assembly;

means for pivotally reclining said back rest assembly about said major pivot points in coordinated movement with said seat assembly during which said seat assembly travels from an initial position to an intermediate-travel position and continues on to a final position wherein:

a. at said initial position the front end and the rear end of said seat assembly are substantially horizontal;

b. at said intermediate-travel position the front end of said seat assembly is tilted upwardly and forwardly advanced from its initial position while its rear end is positioned lower than and forwardly advanced of its initial position, and c. at said final position the front end and the rear end of said seat assembly are substantially horizontal and at substantially the same vertical height as said front and rear ends in the initial position and said front end and rear end are advanced forwardly from their intermediate-travel position.

2. A reclining chair as recited in claim 1 wherein said means for pivotally reclining said back rest assembly about said major pivot points in coordinated movement with said seat assembly comprises:

a first structural means for pivotally reclining said back rest assembly about said fixed major pivot points, said first structural means having a minor pivot point located rearwardly and below each of said major pivot points when said back rest is in its upright position;

a second structural means for pivoting said seat assembly about said minor pivot points; and a third structural means for tilting the front of said seat assembly upwardly at the same time that the rear of said assembly is being pivoted about said minor pivot points.

3. A reclining chair as recited in claim 2 wherein said structural means for pivotally reclining said back rest assembly about said fixed major pivot points comprises a U-shaped frame member that is attached to said back rest assembly adjacent its bottom.

4. A reclining chair as recited in claim 3 wherein said U-shaped frame member has a set of apertures adjacent each of its opposite ends that align respectively with said major pivot points and said minor pivot points.

5. A reclining chair as recited in claim 3 said second structural means for pivoting said seat assembly about said minor pivot points comprises a pair of laterally spaced seat frame brackets extending upwardly from a position adjacent the rear end of said seat assembly, said seat frame brackets each having an aperture formed adjacent its top end for receiving a pin that extends along said minor pivot point.

6. A reclining chair as recited in claim 5 wherein said third structural means for tilting the front of said seat assembly upwardly at the same time that the rear of said seat assembly is being pivoted about said minor pivot points comprises:

a bellcrank pivot point located in each of said sidewall frames adjacent its front end;

a bellcrank pivotally mounted to each of said sidewall frames about said bellcrank pivot points;

a pair of laterally spaced seat frame brackets attached to said seat assembly adjacent its forward end and push rod members having their opposite ends pivotally secured respectively to said seat frame brackets and said bell crank;

a pair of laterally spaced brackets attached to the respective arms of said U-shaped frame member and push rod members having their opposite ends pivotally secured respectively to said brackets and said bellcranks.

7. A reclining chair assembly as recited in claim 6 further comprising a foot rest assembly pivotally attached at its top end to the front end of said seat assembly.

8. A reclining chair assembly as recited in claim 7 further comprising means for coordinating the movement of said foot rest assembly with the movement of said back rest assembly and said seat assembly.

9. A reclining chair assembly as recited in claim 8 wherein said means for coordinating the movement of said foot rest assembly comprises a pair of laterally spaced brackets attached to said foot rest assembly at a point spaced downwardly from where said foot rest assembly is pivotally attached to the front end of said seat assembly and push rod members having their opposite ends pivotally secured respectively to said brackets and said bellcranks.

10. A reclining chair assembly as recited in claim 3 further comprising:

an electric ram having a telescoping ram member;

means pivotally attaching the bottom of said electric ram to said base frame; and means pivotally attaching the top end of said telescoping ram member to said U-shaped frame member.

11. A reclining chair assembly as recited in claim 1 further comprising a pair of laterally spaced rear wheels and rear wheel suspension means for supporting said base frame above ground level by said rear wheels; and a pair of laterally spaced front wheels and front wheel suspension means for supporting said base frame above ground level by said front wheels.

12. A reclining chair assembly as recited in claim 11 wherein said front wheel suspension means has independent suspension structure for each front wheel.

* * * * *